US008447523B2

(12) United States Patent
Reckmann et al.

(10) Patent No.: US 8,447,523 B2
(45) Date of Patent: May 21, 2013

(54) HIGH SPEED DATA TRANSFER FOR MEASURING LITHOLOGY AND MONITORING DRILLING OPERATIONS

(75) Inventors: Hanno Reckmann, Humble, TX (US); Pushkar N. Jogi, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 52 days.

(21) Appl. No.: 12/192,582

(22) Filed: Aug. 15, 2008

(65) Prior Publication Data

US 2009/0201170 A1 Aug. 13, 2009

Related U.S. Application Data

(60) Provisional application No. 60/968,843, filed on Aug. 29, 2007.

(51) Int. Cl.
*G01V 5/04* (2006.01)

(52) U.S. Cl.
USPC ..... 702/11; 702/6; 702/8; 702/9; 702/10

(58) Field of Classification Search
USPC ..... 703/10; 702/6, 8–11; 340/855.5; 175/50, 175/45, 40
See application file for complete search history.

(56) References Cited

U.S. PATENT DOCUMENTS

| | | | | |
|---|---|---|---|---|
| 4,773,263 | A * | 9/1988 | Lesage et al. | 73/152.45 |
| 5,415,030 | A | 5/1995 | Jogi et al. | |
| 6,032,101 | A * | 2/2000 | Freedman et al. | 702/8 |
| 6,583,729 | B1 * | 6/2003 | Gardner et al. | 340/855.4 |
| 7,316,278 | B2 * | 1/2008 | Hutchinson | 175/39 |
| 7,512,034 | B2 * | 3/2009 | Haldorsen | 367/57 |
| 7,596,481 | B2 * | 9/2009 | Zamora et al. | 703/10 |
| 7,782,709 | B2 * | 8/2010 | Esmersoy | 367/31 |
| 2005/0194182 | A1 | 9/2005 | Rodney et al. | |
| 2005/0279532 | A1 | 12/2005 | Ballantyne et al. | |
| 2006/0212224 | A1 | 9/2006 | Jogi et al. | |

FOREIGN PATENT DOCUMENTS

WO 03101047 A2 12/2003

OTHER PUBLICATIONS

Hanno Reckmann, et al. "Using Dynamics Measurements While Drilling to Detect Lithology Changes and to Model Drilling Dynamics". Proceedings of OMAE2007, 26th International Conference on Offshore Mechanics and Arctic Engineering. Jun. 10-15, 2007, San Diego, California USA.

Notification Concering Transmittal of International Preliminary Report on Patentability PCT/US2008/074206; Oct. 6, 2011.

Written Opinion of the International Searching Authority, or the Declaration; PCT/US2008/074206; Oct. 6, 2011.

GB Examination Report for GB Application No. 1004218.2, dated Dec. 7, 2012, pp. 1-3.

Great Britain Office Action for GB Application No. 1004218.2, dated Feb. 27, 2013, pp. 1-5.

* cited by examiner

*Primary Examiner* — Elias Desta
(74) *Attorney, Agent, or Firm* — Cantor Colburn LLP

(57) ABSTRACT

A system for determining at least one of a lithology of a formation traversed by a borehole and an operational condition of a component of a drill string disposed in the borehole is disclosed. The system includes a drill string with a high speed wired pipe telemetry system for transmitting downhole measurements made by a sensor to a computer processing system in real time. The computer processing system is external to the drill string and includes a model that models operation of the drill string and/or a formation that is being drilled. The model receives the downhole measurements and surface measurements of a drilling parameter and provides as output detection of the lithology of the formation and/or the operational condition of the component.

22 Claims, 4 Drawing Sheets

HIGH SPEED DATA TRANSFER FOR MEASURING LITHOLOGY AND MONITORING DRILLING OPERATIONS

CROSS REFERENCE TO RELATED APPLICATION

The present application is filed under 37 CFR §1.53(b) and 35 U.S.C. §120 and claims priority to U.S. Provisional Patent Application Ser. No. 60/968,843, filed Aug. 29, 2007, the entire contents of which are specifically incorporated herein by reference in their entirety

BACKGROUND OF THE INVENTION

1. Field of the Invention

This invention relates to systems, devices, and methods for determining the lithology of a formation and monitoring drilling operations while drilling a borehole. More particularly, this invention relates to systems, devices, and methods that utilize dynamic measurements of selected drilling parameters to determine the lithology of a formation being drilled and to monitor drilling operations.

2. Description of the Related Art

Geologic formations below the surface of the earth may contain reservoirs of oil and gas. Measuring properties of the geologic formations provides information that can be useful for locating the reservoirs of oil and gas. Typically, the oil and gas are retrieved by drilling a borehole into the subsurface of the earth. The borehole also provides access to take measurements of the geologic formations.

One technique for measuring the lithology of a formation is to measure interactions between a drill bit drilling the borehole and the formation. These measurements may be generally referred to as Measurement-While-Drilling (MWD). The measurements are performed using sensors disposed with the drill string attached to the drill bit. The sensors are generally disposed in close proximity to the drill bit. The sensors measure certain dynamic drilling parameters downhole such as weight on bit, torque on bit, rotational speed, bit motion (including acceleration), and bending moments.

The dynamic drilling parameters once obtained may be used to determine a type of lithology. Different types of lithology affect the bit-formation interactions in different ways. By correlating values of the dynamic drilling parameters to the values associated with certain types of lithology, the lithology of the formation being drilled may be determined.

The dynamic drilling parameters may also be used for other purposes such as monitoring drilling operations. Monitoring drilling operations may include diagnosing equipment problems and determining borehole stability.

Data from the sensors can be stored in proximity to the sensors with the drill string or transmitted to the surface for recording and analysis. When the data is stored with the drill string, the data can only be accessed when media storing the data is removed from the drill string. To remove the media requires that the drill string be removed from the borehole. A significant time lag can occur between the time the data was obtained and the time the media is accessed for analysis. When the data is transmitted to the surface, the data may be transmitted via drilling mud pulses. Because of the nature of drilling mud pulses, the data transfer rate may be limited. With both of the above data transfer methods, most of the data processing is performed downhole. The amount of data processing performed downhole can be limited by volume constraints or processor speed.

Therefore, what are needed are techniques to improve data transfer to the surface of the earth when measuring dynamic drilling parameters.

BRIEF SUMMARY OF THE INVENTION

A system for determining at least one of a lithology of a formation traversed by a borehole and an operational condition of a component of a drill string disposed in the borehole, the system including: a sensor for performing downhole measurements of a drilling parameter, the sensor being disposed at least one of at and in the drill string; a high speed wired pipe telemetry system for transmitting the downhole measurements in real time, the telemetry system having a data transfer rate of at least 57,000 bits per second; a processor coupled to the telemetry system for receiving the measurements, the processor disposed external to the drill string; and a computer processing system coupled to the processor, the computer processing system comprising a model that receives the downhole measurements and surface measurements of a drilling parameter as input, the model providing as output at least one of the lithology of the formation and the operational condition of the component.

Also disclosed is a method for determining at least one of a lithology of a formation traversed by a borehole and an operational condition of a component of a drill string disposed in the borehole, the method including: performing downhole measurements of a drilling parameter; transmitting the downhole measurements in real time using a high-speed wired pipe telemetry system, the telemetry system comprising a data transfer rate of at least 57,000 bits per second; receiving the downhole measurements at a location external to the drill string; inputting the downhole measurements into a model; inputting surface measurements of a drilling parameter into the model; and receiving as output from the model at least one of the lithology of the formation and the operational condition of the component.

Further disclosed is a computer program product stored on machine-readable media having machine-executable instructions for determining at least one of a lithology of a formation traversed by a borehole and an operational condition of a component of a drill string disposed in the borehole, the instructions including: receiving downhole measurements of a drilling parameter using a high-speed wired pipe telemetry system, the telemetry system comprising a data transfer rate of at least 57,000 bits per second; inputting the downhole measurements into a model; inputting surface measurements of a drilling parameter into the model; and receiving as output from the model at least one of the lithology of the formation and the operational condition of the component.

BRIEF DESCRIPTION OF THE DRAWINGS

The subject matter, which is regarded as the invention, is particularly pointed out and distinctly claimed in the claims at the conclusion of the specification. The foregoing and other features and advantages of the invention are apparent from the following detailed description taken in conjunction with the accompanying drawings, wherein like elements are numbered alike, in which:

DETAILED DESCRIPTION OF THE INVENTION

Figure 1:
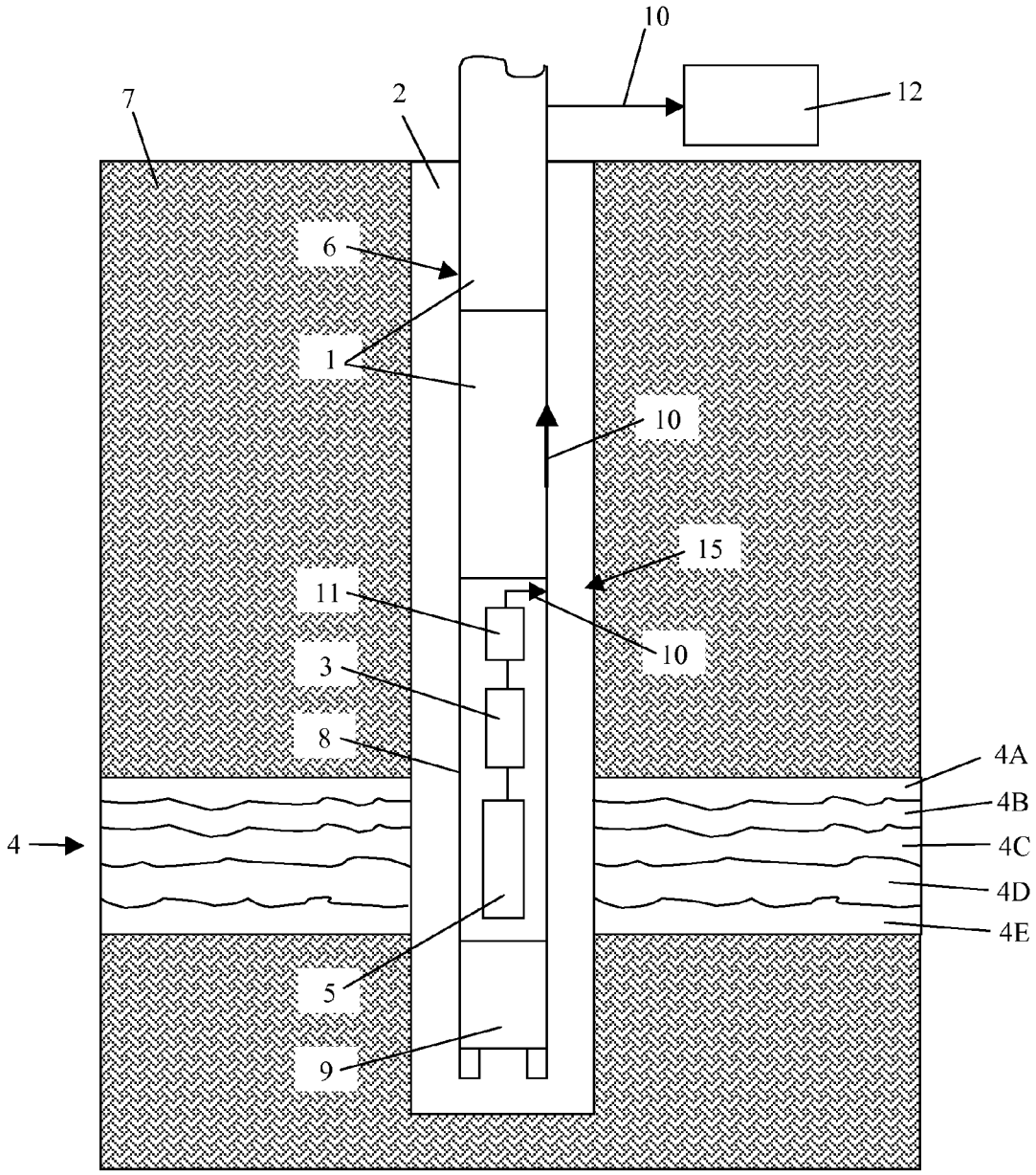
FIG. 1 illustrates an exemplary embodiment of a drill string disposed in a borehole penetrating the earth.

This disclosure relates to techniques for and methods enabled by high-speed transfer of data obtained from the measurement of drilling parameters in a borehole. High-speed data transfer enables improved data processing because most of the processing can be performed at the surface. At the surface, more sophisticated data processing apparatus may be used because there are few if any volume constraints. The sophisticated data processing apparatus also allows for greater latitude in software available to process raw data so that the processing apparatus is capable of recognizing more types of formations than has been previously possible. In addition, improved response time is realized when measurements of the drilling parameters indicate drilling problems, since the measurements are processed in real time at the surface. Further, because most data processing is performed in an environment outside of the borehole, reliability of the processed information is improved. This is additionally true for other electronics associated with the measurement of a target parameter. Because all electronics but the actual sensor can be relocated to a more favorable environmental position, reliability of each of the components so located and the system as a whole is improved.

For convenience, certain definitions are provided. The term "dynamic" relates to measuring a parameter at a point in time rather than an average taken over an interval of time. For example, rotational speed may be measured every second and the measurements transmitted to the surface of the earth. In contrast, with non-dynamic measurements, rotational speed may be averaged over a period of time such as for example a minute and only the average value stored or transmitted to the surface. The term "drilling parameter" relates to parameters associated with drilling the borehole. Non-limiting examples of drilling parameters include weight on bit, torque on bit, drill bit revolution, drill string revolution, axial acceleration, tangential acceleration, lateral acceleration, torsional acceleration, and bending moments. The term "sampling rate" relates to the rate at which a drilling parameter is measured. For example, a sampling rate of 200 Hz provides for measuring a drilling parameter 200 times each second.

The term "dynamic sensing system" relates to a system that includes at least one sensor disposed downhole with a drill string for measuring a drilling parameter, electronics (which may be incorporated in the sensor) coupled to the sensor for operating the sensor, telemetry coupled to the electronics for high speed data transfer from the sensor to the surface of the earth and from the surface of the earth to the sensor, and a processing unit disposed external to the drill string usually at the surface of the earth. The processing unit is used to transmit and receive data using the telemetry. Data transmitted from the sensor includes measurements of the drilling parameter.

The term "lithology" relates to a characteristic of an earth or rock formation. Examples of the characteristic include mineral content, grain size, texture, and color. The term "operational condition" relates to the ability of a component of the drill string to perform a function. The operational condition of the component excludes ambient conditions such as temperature and pressure that do not indicate if the component is performing its function or not. In some embodiments, the operational condition includes internal pressures and temperatures which could indicate malfunctions of components (i.e. electronic boards or hydraulic systems).

Referring to FIG. 1, an exemplary embodiment of a drill string 6 is shown disposed in a borehole 2. The drill string 6 includes a plurality of drill pipes 1 assembled to each other axially to extend deep into the Earth 7. The borehole 2 is drilled through earth 7 and penetrates formations 4, which include various formation bedding planes 4A-4E. A sensor 5 is shown disposed in or at the drill string 6 in proximity to a drill bit 9. The sensor 5 is used to measure at least one dynamic drilling parameter. The drill string 6 also includes an electronics unit 3 and a telemetry arrangement 11 disposed within a housing 8. The housing 8, which may be part of a bottom hole assembly, is adapted for use in the borehole 2 with the drill string 6. With respect to the teachings herein, the housing 8 may represent any structure used to support or contain at least one of the sensor 5, the electronics unit 3 and the telemetry arrangement 11.

The sensor 5 is operably coupled to the electronics unit 3 both for sensed signal provision to the electronics unit 3 and for command activity from the electronics unit 3 to the sensor 5. The electronics unit 3 is in turn operably connected to the telemetry arrangement 11. The telemetry arrangement 11 is capable of and positioned to communicate a telemetry signal 10 to the surface of the Earth 7 or other remote location as desired. The telemetry signal 10 includes dynamic measurements performed by the sensor 5. It will be appreciated that telemetry arrangement 11 is also capable of sending signals from the surface or remote location to the electronics unit 3 at the drill bit 9. In some instances, the telemetry signal 10 includes information related to the at least one dynamic drilling parameter measured by the sensor 5. At the surface of the Earth 7, the telemetry signal 10 is received and processed by a surface processing unit 12. Processing may include at least one recording and/or signal analysis. Alternatively, the surface processing unit 12 may transmit the telemetry signal 10 or data associated with the telemetry signal 10 to another location (not depicted) for processing. In one embodiment, the Internet may be used for transferring the data to another location. A dynamic sensing system 15 includes the sensor 5, the electronics unit 3, the telemetry arrangement 11, and the surface processing unit 12.

In typical embodiments, the borehole 2 includes materials such as would be found in oil exploration, including a mixture of liquids such as water, drilling fluid, mud, oil and other formation fluids that are indigenous to the various formations. It will be recognized that the various features and materials as may be encountered in a subsurface environment may be referred to as "formations." Accordingly, it should be considered that while the term "formation" generally refers to geologic formations of interest, that the term "formations," as used herein, may, in some instances, include any geologic points of interest (such as a survey area) or geologic subsurface material.

The telemetry arrangement 11 and the surface processing unit 12 shown in FIG. 1 provide for high speed data transfer. The high speed data transfer enables sampling rates of the dynamic drilling parameters at up to 200 Hz or higher with each sample being transmitted to the surface of the Earth 7. The telemetry arrangement 11 uses a signal transfer medium to transfer the data to the surface processing unit 12. The signal transfer medium may be considered as part of the dynamic sensing system 15. One exemplary embodiment of the signal transfer medium for high speed data transfer is "wired pipe," which is included in a wired pipe telemetry system.

Figure 2:
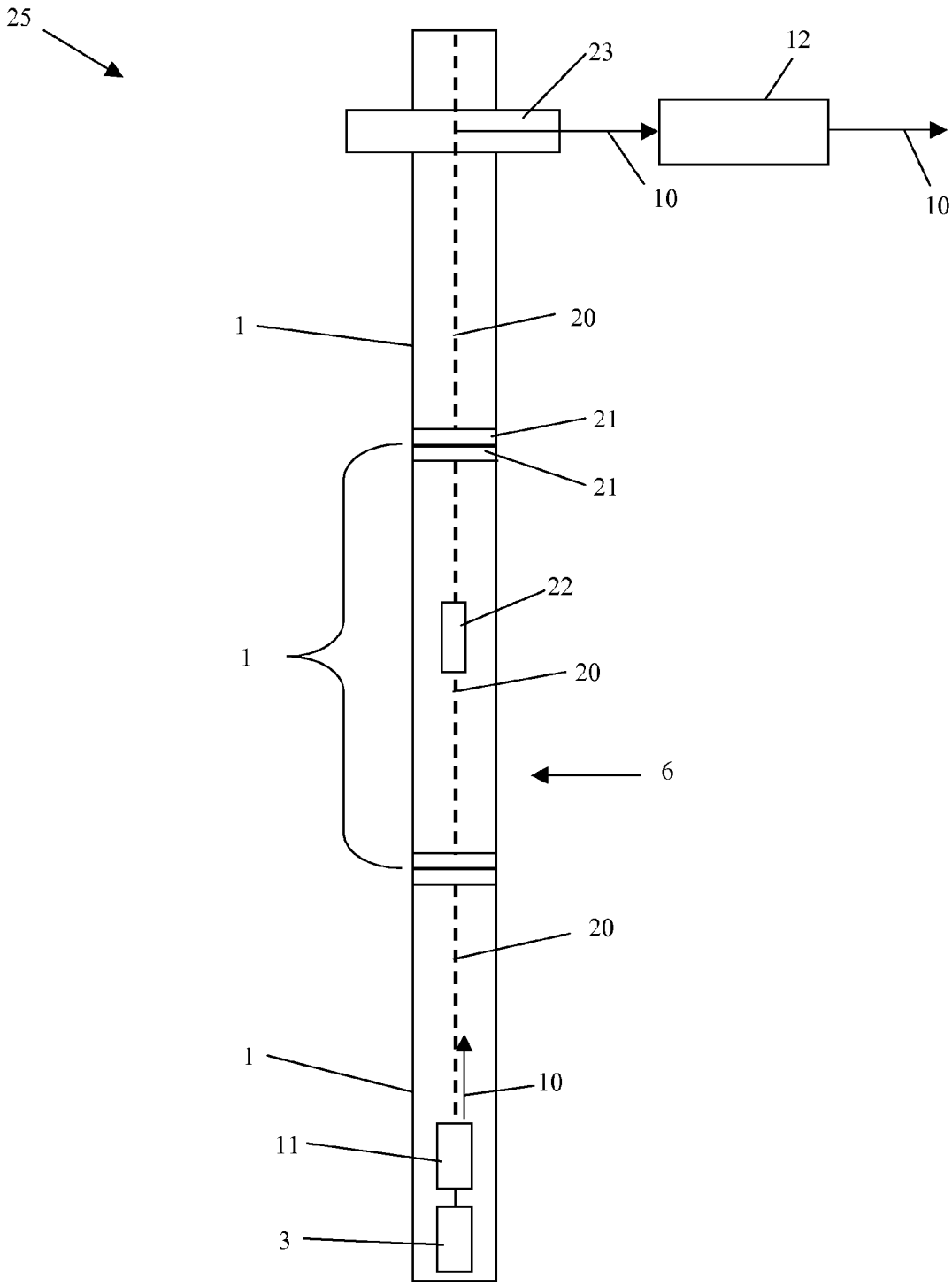
FIG. 2 depicts aspects of a wired pipe telemetry system.

FIG. 2 illustrates aspects of a wired pipe telemetry system 25. In one embodiment of the wired pipe telemetry system 25, each drill pipe 1 is modified to include a broadband cable 20 protected by a reinforced steel casing. At the end of each drill pipe 1, there is an inductive coil 21, which contributes to communication between two drill pipes 1. In this embodiment, the telemetry arrangement 11 includes the wired pipe telemetry system 25. The electronics unit 3 transmits the telemetry signal 10, which includes data from measurements of a dynamic drilling parameter, via the telemetry arrangement 11. About every 500 meters, a signal amplifier 22 is disposed in operable communication with the broadband cable 20 to amplify the telemetry signal 10 to account for signal loss. The surface processing unit 12 receives the telemetry signal 10 from the drill pipe 1 at the surface of the Earth 7 or other location external to the drill string 6 via a swivel coupling 23. The swivel coupling 23, referred to as a "data swivel," is used transmit the telemetry signal 10 from the rotating drill string 6 to the surface processing unit 12.

One example of the wired pipe telemetry system 25 is the IntelliServe® network, which includes IntelliPipe® (i.e., wired pipe). The IntelliServe network is commercially available from Intellipipe of Provo, Utah, a division of Grant Prideco. The IntelliServe network can have data transfer rates from 57,000 to over 1,000,000 bits per second.

As discussed above, the dynamic sensing system 15 provides for improved data processing because of the high speed data transfer. In one embodiment, the data processing can include a frequency domain analysis of the data provided by the sensor 5. Changes in a frequency domain spectrum can indicate a change in lithology of the formation 4, a problem with drilling equipment, or a change in surface drilling parameters. Since the surface drilling parameters are measured on the surface of the Earth 7, and therefore known, the effect of the surface drilling parameters can be separated from lithology changes and problems with the drilling equipment. In another embodiment, a time domain analysis of the data provided by the sensor 5 may be used.

Typically, the dynamic sensing system 15 includes adaptations as may be necessary to provide for operation during drilling or after a drilling process has been undertaken.

Figure 3:
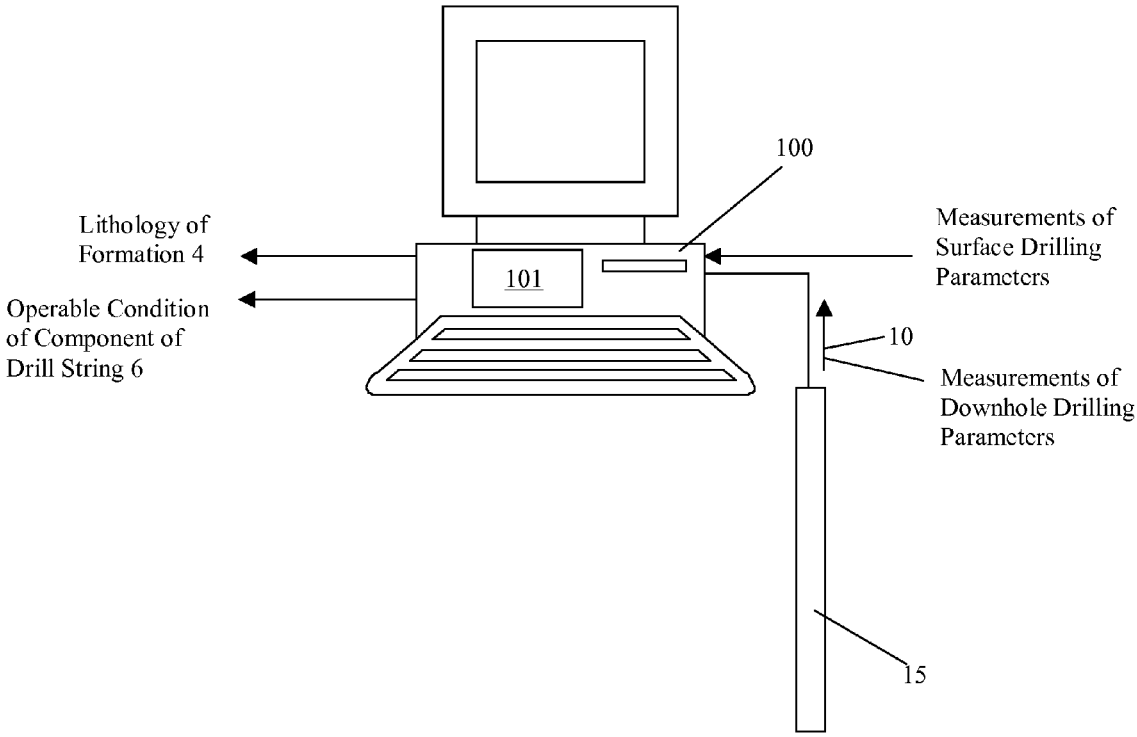
FIG. 3 illustrates an exemplary embodiment of a computer processing system coupled to a dynamic sensing system.

Referring to FIG. 2, an apparatus for implementing the teachings herein is depicted. In FIG. 3, the apparatus includes a computer processing system 100 coupled to the dynamic sensing system 15. Generally, the computer 100 includes components as necessary to provide for the real time processing of data from the dynamic sensing system 15. Exemplary components of the computer processing system 100 include, without limitation, at least one processor, storage, memory, input devices, output devices and the like. As these components are known to those skilled in the art, these are not depicted in any detail herein. It will be appreciated that a function or functions of the surface processing unit 12 can be incorporated into the computer processing system 100. Real time transmission of measurements includes transmission of dynamic measurements from the sensor 5 and any measurements averaged within the drill string 6.

The teachings herein are with respect to output of the computer processing system 100 are generally reduced to an algorithm 101 that is stored on machine-readable media. The algorithm 101 is implemented by the computer processing system 100 and provides operators with desired output.

The algorithm 101 generally includes a model of at least one of mechanical operation of the drill string 6, a cutting process resulting from the operation of the drill string 6, and a lithology of the formation 4. The model uses at least one downhole dynamic drilling parameter as input. In addition, the model can use at least one surface drilling parameter as input. The surface drilling parameter can be used for verification of the at least one downhole dynamic drilling parameter. For example, if any of the downhole drilling parameters change and the surface drilling parameters do not change, then the change of any of the downhole drilling parameters can be attributed to a change in the lithology of the formation 4 or a change in operable condition of a component of the drill string 6.

The model can provide several types of output. For example, the model can provide a state of the drill string 6 or a state of a component of the drill string 6. When the dynamic drilling parameters change, then the model can detect a change in the state of the drill string 6 or a change in state of the component. Thus, a broken component such as the drill bit 9 can be detected and the algorithm 101 can indicate that the drill bit 9 needs to be replaced. In addition, the model can detect a lithology of the formation 4 being penetrated by the drill bit 9. Further, the model can detect changes to the lithology resulting from changes to the dynamic drill parameters. By modeling the cutting process, the model can indicate a type of drill bit 9 to use that will be optimized for cutting the formation 4 that has a particular lithology detected by the model. The model can also indicate a selection of other drill string components to optimize the cutting process.

In general, the model can be developed using at least one of historical data and current data including measurements the dynamic drilling parameters. For example, measurements of the dynamic drilling parameters can be compared to historical data to determine a lithology of the formation 4 being drilled. Other data, such as data obtained recently from samples, can be used to refine the model.

The output of the computer processing system 100 is usually generated on a real-time basis. As used herein, generation and transmission of data in "real-time" is taken to mean generation and transmission of data at a rate that is useful or adequate for making decisions during or concurrent with processes such as production, experimentation, verification, and other types of surveys or uses as may be opted for by a user or operator. As a non-limiting example, real-time measurements and calculations may provide users with information necessary to make desired adjustments during the drilling process. In one embodiment, adjustments are enabled on a continuous basis (at the rate of drilling), while in another embodiment, adjustments may require periodic cessation of drilling for assessment of data. Accordingly, it should be recognized that "real-time" is to be taken in context, and does not necessarily indicate the instantaneous determination of data, or make any other suggestions about the temporal frequency of data collection and determination.

A high degree of quality control over the data may be realized during implementation of the teachings herein. For example, quality control may be achieved through known techniques of iterative processing and data comparison. Accordingly, it is contemplated that additional correction factors and other aspects for real-time processing may be used. Advantageously, the user may apply a desired quality control tolerance to the data, and thus draw a balance between rapidity of determination of the data and a degree of quality in the data.

Figure 4:
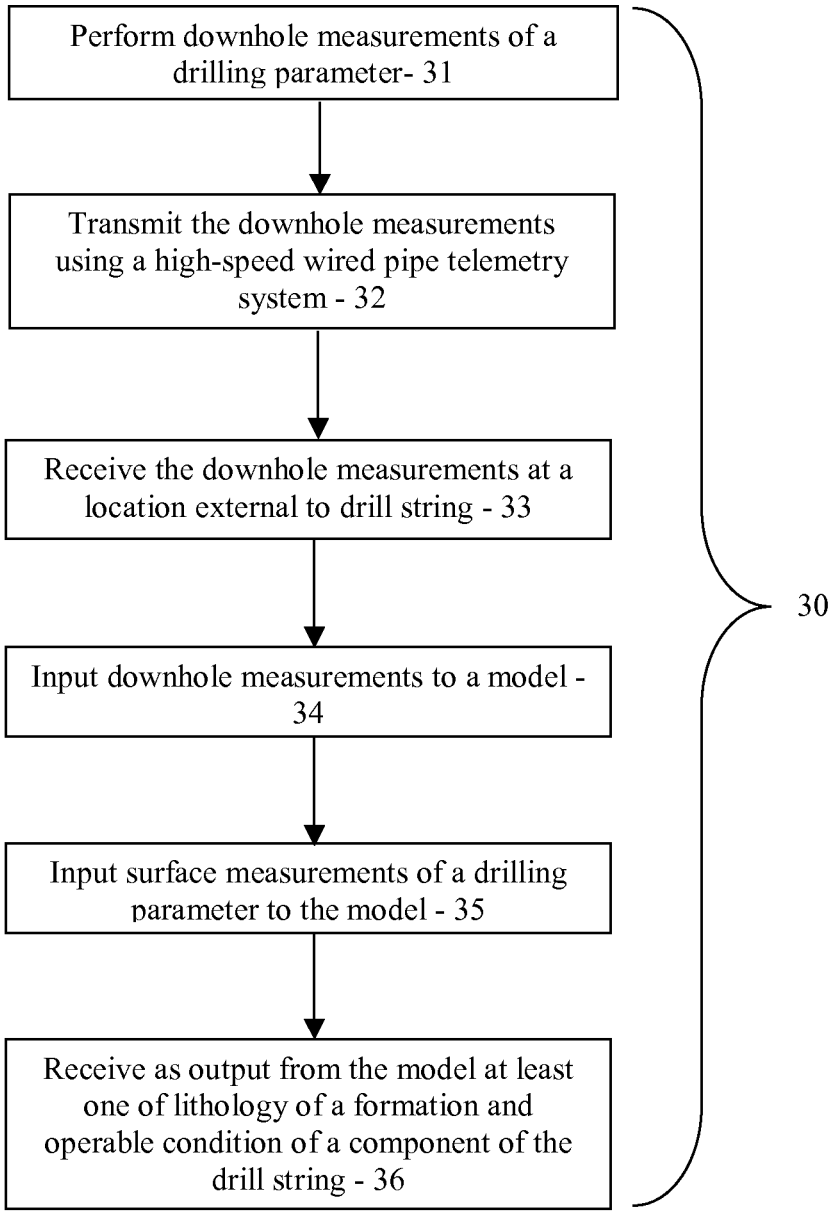
FIG. 4 presents an example of a method for determining at least one of a lithology of a formation traversed by the borehole and an operable condition of a component of the drill string disposed in the borehole.

FIG. 4 presents an exemplary method 30 for determining at least one of a lithology of the formation 4 traversed by the borehole 2 and an operable condition of a component of the drill string 6 disposed in the borehole 2. The method 30 includes performing (step 31) downhole measurements of a drilling parameter using the sensor 5. The downhole measurements can be dynamic measurements or averaged measurements such as those averaged over a five second interval. Further, the method 30 includes transmitting (step 32) the downhole measurements using the high-speed wired pipe telemetry system 25. Further, the method 30 includes receiving (step 33) the measurements at a location external to the drill string 6. Further, the method 30 includes inputting (step 34) the downhole measurements to a model. Further, the method 30 includes inputting (step 35) surface measurements of at least one drilling parameter to the model. Further, the method 30 includes receiving (step 36) as output from the model at least one of the lithology and the operable condition.

In certain embodiments, more than one sensor 5 may be used in the drill string 6. Using multiple sensors 5 to measure multiple dynamic drilling parameters is considered inherent to the teachings herein and a part of the invention disclosed.

In certain embodiments, multiple sensors 5 may be disposed in various locations along the drill string 6. In these embodiments, a transfer function may be used with data provided by the sensors 5 to account for effects relating to the distance from each sensor 5 to the drill bit 9 or relating to the distance from one sensor 5 to another sensor 5. From signals from one or more of the sensors 5, the transfer function between the one or more sensors 5 can be obtained. Changes in the transfer function can indicate changes in the dynamic sensing system 15. The transfer function can be included in the algorithm 101 for implementation by the computer processing system 100.

In support of the teachings herein, various analyses and/or analytical components may be used, including digital and/or analog systems. The system may have components such as a processor, storage media, memory, input, output, communications link (wired, wireless, pulsed mud, optical or other), user interfaces, software programs, signal processors (digital or analog) and other such components (such as resistors, capacitors, inductors and others) to provide for operation and analyses of the apparatus and methods disclosed herein in any of several manners well-appreciated in the art. It is considered that these teachings may be, but need not be, implemented in conjunction with a set of computer executable instructions stored on a computer readable medium, including memory (ROMs, RAMs), optical (CD-ROMs), or magnetic (disks, hard drives), or any other type that when executed causes a computer to implement the method of the present invention. These instructions may provide for equipment operation, control, data collection and analysis and other functions deemed relevant by a system designer, owner, user or other such personnel, in addition to the functions described in this disclosure.

Further, various other components may be included and called upon for providing aspects of the teachings herein. For example, a sample line, sample storage, sample chamber, sample exhaust, pump, piston, power supply (e.g., at least one of a generator, a remote supply and a battery), vacuum supply, pressure supply, refrigeration (i.e., cooling) unit or supply, heating component, motive force (such as a translational force, propulsional force or a rotational force), magnet, electromagnet, sensor, electrode, transmitter, receiver, transceiver, controller, optical unit, electrical unit or electromechanical unit may be included in support of the various aspects discussed herein or in support of other functions beyond this disclosure.

Elements of the embodiments have been introduced with either the articles "a" or "an." The articles are intended to mean that there are one or more of the elements. The terms "including" and "having" are intended to be inclusive such that there may be additional elements other than the elements listed. The conjunction "or" when used with a list of at least two terms is intended to mean any term or combination of terms.

It will be recognized that the various components or technologies may provide certain necessary or beneficial functionality or features. Accordingly, these functions and features as may be needed in support of the appended claims and variations thereof, are recognized as being inherently included as a part of the teachings herein and a part of the invention disclosed.

While the invention has been described with reference to exemplary embodiments, it will be understood that various changes may be made and equivalents may be substituted for elements thereof without departing from the scope of the invention. In addition, many modifications will be appreciated to adapt a particular instrument, situation or material to the teachings of the invention without departing from the essential scope thereof Therefore, it is intended that the invention not be limited to the particular embodiment disclosed as the best mode contemplated for carrying out this invention, but that the invention will include all embodiments falling within the scope of the appended claims.

What is claimed is:

1. A system for determining a lithology of a formation traversed by a borehole, the system comprising:

a sensor for performing downhole measurements of a drilling parameter, the sensor being disposed at a drill string disposed in the borehole;

a high speed wired pipe telemetry system for transmitting the downhole measurements in real time, the telemetry system having a data transfer rate of at least 57,000 bits per second;

a processor coupled to the telemetry system for receiving the measurements, the processor disposed external to the drill string; and a computer processing system coupled to the processor, the computer processing system comprising a model that receives the downhole measurements and surface measurements of a drilling parameter as input, the model providing as output detection of the lithology of the formation.

2. The system as in claim 1, wherein the measurements comprise at least one of dynamic measurements and averaged measurements.

3. The system of claim 1, wherein the sensor is disposed adjacent to a drill bit disposed at the drill string.

4. The system of claim 1, wherein the drilling parameter comprises at least one of weight on bit, torque on bit, drill bit revolution, drill string revolution, axial acceleration, tangential acceleration, lateral acceleration, torsional acceleration, and bending moments.

5. The system as in claim 1, wherein the telemetry system comprises:

a broadband cable disposed in each section of drill pipe in the drill string;

an inductive coil disposed at least at one end of each section of drill pipe, the coil coupled to the broadband cable;

at least one signal amplifier disposed in at least one section of drill pipe, the amplifier coupled to the broadband cable; and a data swivel coupled to the broadband cable and the processor, the data swivel providing for transmitting the downhole measurements from the broadband cable to the processor while the drill string is at least one of rotating and stationary.

6. The system of claim 1, wherein the output comprises a change in the lithology.

7. The system of claim 1, wherein the output of the model further comprises detection of a malfunction of a component of the drill string.

8. The method of claim 7, wherein the output further comprises a change in an operational condition of the component.

9. The system of claim 7, wherein the component comprises a drill bit.

10. The system of claim 1, wherein the output comprises an identification of a drill bit optimized for drilling the formation, the formation having the lithology determined by the model.

11. The system of claim 1, wherein the model comprises a transfer function to account for effects relating to a distance from the sensor to at least one of a drill bit and another sensor.

12. A method for determining a lithology of a formation traversed by a borehole, the method comprising:

performing downhole measurements of a drilling parameter;

transmitting from a drill string disposed in the borehole the downhole measurements in real time using a high-speed wired pipe telemetry system, the telemetry system comprising a data transfer rate of at least 57,000 bits per second;

receiving the downhole measurements at a location external to the drill string;

inputting the downhole measurements into a model;

inputting surface measurements of a drilling parameter into the model; and receiving as output from the model detection of the lithology of the formation.

13. The method of claim 12, wherein the downhole measurements are sampled at a sampling rate exceeding about 200 Hz.

14. The method of claim 12, wherein the downhole measurements comprise at least one of dynamic measurements and averaged measurements.

15. The method of claim 14, further comprising determining a frequency spectrum from the dynamic measurements.

16. The method of claim 15, further comprising calculating a change in the frequency spectrum.

17. The method of claim 16, further comprising correlating the change in the frequency spectrum to a change in the lithology.

18. The method of claim 17, further comprising using the change in the lithology to indicate a type of drill bit optimized for drilling the formation.

19. The method of claim 12, further comprising receiving as output from the model detection of a malfunction of a component of the drill string.

20. The method of claim 19, further comprising correlating a change in a frequency spectrum determined from dynamic measurements obtained from the downhole measurements to a change in an operational condition of the component.

21. The method of claim 19, wherein the component is a drill bit.

22. A non-transitory computer readable medium containing computer-executable instructions stored therein for causing a computer processor to determine a lithology of a formation traversed by a borehole, the instructions comprising:

receiving downhole measurements of a drilling parameter using a high-speed wired pipe telemetry system, the telemetry system comprising a data transfer rate of at least 57,000 bits per second;

inputting the downhole measurements into a model;

inputting surface measurements of a drilling parameter into the model; and receiving as output from the model detection of the lithology of the formation.

* * * * *